US005804545A

United States Patent [19]

Hemling et al.

[11] Patent Number: 5,804,545

[45] Date of Patent: Sep. 8, 1998

[54] STABLE ALKALINE CHLORINE COMPOSITIONS

[75] Inventors: Thomas C. Hemling, Lake Winnebago; Cynthia L. Palmer, Kansas City, both of Mo.

[73] Assignee: West Argo, Inc., Kansas City, Mo.

[21] Appl. No.: 616,771

[22] Filed: Mar. 15, 1996

Related U.S. Application Data

[63] Continuation of Ser. No. 334,695, Nov. 4, 1994, abandoned, which is a continuation of Ser. No. 159,051, Nov. 29, 1993, abandoned, which is a continuation-in-part of Ser. No. 157,922, Nov. 24, 1993, abandoned.

[51] Int. Cl.[6] ..... C11D 3/395

[52] U.S. Cl. ..... 510/373; 510/380; 510/433; 510/437; 252/186.36; 252/187.25

[58] Field of Search ..... 252/186.26, 186.36, 252/186.37, 187.25; 510/433, 437, 373, 380

[56] References Cited

U.S. PATENT DOCUMENTS

| | | | |
|---|---|---|---|
| 3,560,389 | 2/1971 | Hunting | 510/370 |
| 3,684,722 | 8/1972 | Hynam et al. | 252/187.25 |
| 3,956,158 | 5/1976 | Donaldson | 510/369 |
| 4,229,313 | 10/1980 | Joy | 252/187.25 |
| 4,271,030 | 6/1981 | Brierley et al. | 252/187.26 |
| 4,282,109 | 8/1981 | Citrone et al. | 510/373 |
| 4,337,163 | 6/1982 | Schilp | 252/187.24 |
| 4,388,204 | 6/1983 | Dimond et al. | 510/195 |
| 4,526,700 | 7/1985 | Hensley et al. | 510/513 |
| 4,552,680 | 11/1985 | Hartman et al. | 252/187.25 |
| 4,588,514 | 5/1986 | Jones | 252/187.25 |
| 4,790,953 | 12/1988 | Mansy | 252/187.26 |
| 5,057,236 | 10/1991 | Petrin et al. | 510/324 |
| 5,075,029 | 12/1991 | Haendler | 252/186.25 |
| 5,348,682 | 9/1994 | Finley et al. | 510/373 |
| 5,529,711 | 6/1996 | Brodbeck et al. | 510/373 |

FOREIGN PATENT DOCUMENTS

| | | |
|---|---|---|
| 145084 | 6/1985 | European Pat. Off. . |
| 244611 | 11/1987 | European Pat. Off. . |
| 2837889 | 5/1987 | Germany . |
| 61-123700 | 6/1986 | Japan . |
| 2-218798 | 8/1990 | Japan . |
| 148103 | 12/1975 | Netherlands . |
| 1329086 | 2/1973 | United Kingdom . |
| 1466560 | 3/1977 | United Kingdom . |

OTHER PUBLICATIONS

Stepan Certificate of Analysis; Jun. 14, 1991; Ammonyx MCO; CQ–081.

Stepan Certificate of Analysis; Nov. 24, 1992; Bio–Soft S–100; CA–055.

Stepan Certificate of Analysis; Jun. 20, 1992; Ammonyx MO; CQ–079.

Stepan Certificate of Analysis; Mar. 13, 1990; Ammonyx SO; CQ–078.

Stepan Certificate of Analysis; May 15, 1992; Ammonyx DMCD 40; CA–077.

Stepan Certificate of Analysis; Nov. 24, 1992; Ammonyx LO; CA–075.

Stepan Certificate of Analysis; May 15, 1992; Ammonyx CDO; CQ–082.

English language translation of JP 2–218,798, Kao Corp, pp. 1–12, Aug. 1990.

*Primary Examiner*—Douglas J. McGinty
*Assistant Examiner*—Caroline L. Dusheck
*Attorney, Agent, or Firm*—Hovey,Williams, Timmons & Collins

[57] ABSTRACT

Improved alkaline chlorinated concentrate compositions are provided which exhibit reduced chlorine loss over extended storage periods and which, when diluted, yield high foaming chlorinated use solutions. The concentrate compositions of the invention include from about 0.5-8% by weight alkali metal hypochlorite, from about 1.0-20% by weight of alkali metal hydroxide, and at least about 3% by weight of a surfactant system including respective amounts of a chlorine-stable trialkylamine oxide and a saturated $C_6$–$C_{12}$ fatty acid soap, with an amine oxide:fatty acid soap weight ratio of from about 90:10 to about 25:75. The pH of the concentrates exceeds 12.5.

9 Claims, 3 Drawing Sheets

ACTUAL
THEORETICAL
% CHLORINE LOSS
75
70
65
60
55
50
45
40
LAO 100 0
C8 0 100
80 20
60 40
40 60
20 80
0 100
% LAO (100–0%) : % C8 (0–100%)

STABLE ALKALINE CHLORINE COMPOSITIONS

This application is a continuation of application Ser. No. 08/334,695, filed Nov. 4, 1994, now abandoned, which is a continuation of Ser. No. 08/159,051, filed Nov. 29, 1993, now abandoned, which is a continuation-in-part of Ser. No. 08/157,922, filed Nov. 24, 1993, now abandoned.

BACKGROUND OF THE INVENTION

1. Field of the Invention

The present invention is broadly concerned with improved, stable aqueous chlorine compositions exhibiting reduced chlorine losses as compared with comparative theoretical chlorine losses. More particularly, the compositions of the invention include respective amounts of alkali metal hypochlorite, and alkali metal hydroxide, along with a surfactant system including quantities of a chlorine-stable trialkylamine oxide and a saturated $C_6$–$C_{12}$ fatty acid soap; the compositions moreover have a pH in excess of 12.5 and, preferably, are especially formulated for reduced chlorine loss as compared with the comparative theoretical loss for the compositions.

2. Description of the Prior Art

Chlorine-containing cleaning and bleaching compositions have been provided in the past, which are typically used as stain removers and germicides. For example, in the food processing industry it is common to clean soils from equipment using such alkaline chlorinated cleaners which rapidly break down, solubilize and remove most common soils. In the cleaning of certain types of food processing equipment, it is desirable to apply a chlorinated cleaner as a foam, in order to increase the contact time between the cleaning composition and the soil. Most of these products are supplied in the form of concentrates, and are diluted in water immediately prior to use.

The ability to develop effective, high foaming chlorinated alkaline concentrate compositions is limited by the relative instability of most surfactants to hypochlorites (bleach). Many surfactants are readily oxidized or chlorinated in the presence of bleach. This leads to a reduction in the performance of the surfactant components, as well as a loss, or reduction, in the amount of bleach present. Additionally, an effective high foaming chlorinated cleaning composition requires surfactants that are readily soluble in high concentrations of electrolytes, particularly alkaline materials. Certain surfactants are known to be relatively chlorine stable at low concentrations in bleach. These include the amine oxides, alkyl diphenyl ether disulfonates, alkane sulfonates, and alkyl benzene sulfonates. See, e.g., U.S. Pat. Nos. 4,552,680, 4,337,163, 4,271,030, 4,229,313 and 3,684,722.

In order to improve the solubility of surfactants in a concentrated electrolyte solution, hydrotropes are sometimes used. These are organic compounds which themselves must also be relatively stable in chlorinated systems.

Accordingly, the requirements for a successful high foaming chlorinated cleansing composition are exceedingly stringent, with the most troublesome difficulty being maintenance of adequate chlorine levels over long storage periods.

SUMMARY OF THE INVENTION

The present invention overcomes the problems outlined above, and provides improved concentrate compositions which have a high degree of chlorine stability while retaining the desirable physical properties for an effective cleanser. The invention is predicated upon the discovery that improved aqueous compositions can be formulated through use of specific levels of alkali metal hydroxide and a surfactant system, the latter including chlorine-stable trialkylamine oxide and a $C_6$–$C_{12}$ fatty acid soap wherein the amine oxide:fatty acid soap weight ratio is from about 90:10 to 25:75. Further, the compositions of the invention in concentrate form have a pH above 12.5, and preferably above about 13.

In more detail, the compositions include from about 0.5–8% by weight of alkali metal hypochlorite, particularly sodium hypochlorite, NaOCl, as well as the potassium and lithium hypochlorite salts. A more preferred hypochlorite range is from about 1.5–5% by weight.

The concentrate compositions should contain from about 1.0–20% by weight alkali metal hydroxide, and more preferably from about 3–12% by weight thereof. The most preferred hydroxides are sodium and potassium hydroxide, and blends thereof, although there are other possibilities.

The surfactant system of the invention should be present at a level of at least about 3% by weight in the concentrate compositions, and more preferably from about 3.5–6% by weight. Advantageously, the concentrates should include from about 0.75–6% by weight trialkylamine oxide, and more preferably from about 0.875–4.5% by weigh thereof. Correspondingly, the concentrate compositions should include from about 0.75–6% by weight $C_6$–$C_{12}$ fatty acid soap, and more preferably from about 0.875–4.5% by weight thereof. In terms of the amine oxide:fatty acid soap weight ratio, the more preferred range for this ratio is from about 75:25 to 25:75.

The most preferred amine oxides useful in the surfactant systems of the invention are of the formula

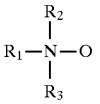

where $R_1$ is a saturated $C_{8-C16}$ alkyl group (which is preferably linear), and $R_2$ and $R_3$ are each individually taken from the group consisting of $C_1$–$C_4$ alkyl groups. In preferred practice, $R_2$ and $R_3$ are each a methyl group, whereas $R_1$ would typically be selected from the $C_8$–$C_{12}$ linear alkyl groups.

In practice the ingredients of the concentrate compositions are dispersed or dissolved in water; and other optional ingredients can be provided which do not detract from the useful properties of the compositions (e.g., chlorine stable polyacrylates, sodium tripolyphosphate, silicates or other sources of alkalinity and other chlorine stable surfactants). In particularly preferred forms, the concentrate compositions of the invention consists essentially of the indicated essential and/or optional ingredients.

The concentrate compositions of the invention are preferably formulated for giving the compositions a reduced chlorine loss, as compared with the comparative theoretical chlorine losses for the compositions. The definition and means of calculation of comparative theoretical chlorine loss for the compositions of the invention is set forth, infra.

The concentrates are typically diluted in water to yield use compositions. Generally, the final use solutions contain from about 0.2–5% by weight of the concentrate, with the remainder of the use solution being water.

DETAILED DESCRIPTION OF THE PREFERRED EMBODIMENT

The following Examples set forth preferred concentrate compositions and techniques for formulation thereof, as well as test results demonstrating the chlorine stability of the compositions. It is to be understood, however, that these Examples are presented by way of illustration only and nothing therein should be taken as a limitation upon the overall scope of the invention.

EXAMPLES 1–69

The stable chlorinated alkaline compositions of these examples were prepared by mixing the indicated ingredients in the following order: water, potassium hydroxide, sodium hydroxide, polyacrylate, amine oxide, fatty acid soap, and bleach (hypochlorite). The compositions were stored in glass containers at 40° C. for eight weeks (some for only four weeks). The actual available chlorine loss for each composition (determined by thiosulfate titration) was compared to the theoretical chlorine loss for each respective composition.

The theoretical percent chlorine loss for each composition, as used below, was calculated as follows:

$$\%\ \text{chlorine loss theoretical} = \frac{A1 \times A2}{A3} + \frac{A4 \times A5}{A6}$$

where:

A1=wt. percent amine oxide in test composition;

A2=chlorine loss in amine oxide reference composition (i.e., containing no fatty acid soap);

A3=wt. percent amine oxide in amine oxide reference composition;

A4=wt. percent soap in test composition;

A5=chlorine loss in soap reference composition (i.e., containing no amine oxide); and A6=wt. percent soap in soap reference composition.

In Table 1 below, Examples 1–6 are directed only to $C_9$ soap (potassium nonanoate) and show the effect of varying the weight ratio of amine oxide to soap in the surfactant system (while maintaining the surfactant concentration essentially constant (4.64–4.65%)) on the chlorine loss during an 8-week period. Example 1 is the soap reference composition for the $C_9$ soap tests, whereas Example 6 is the amine oxide reference composition for these tests.

TABLE 1

| Composition | Wt. % Lauramine Oxide (30% by wt. solution) | Wt. % Potassium Nonanoate (45% by wt. solution) | Total Active Surfactant | Wt. Ratio Amine Oxide:Soap | % Chlorine Loss 8 Weeks | % Chlorine Loss Theoretical |
|---|---|---|---|---|---|---|
| 1 | 0 | 10.30 | 4.64% | 0:100 | 62 | |
| 2 | 11.63 | 2.258 | 4.65% | 75:25 | 59 | 65 |
| 3 | 7.75 | 5.20 | 4.65% | 50:50 | 59 | 64 |
| 4 | 13.95 | 1.00 | 4.64% | 90:10 | 64 | 65 |
| 5 | 3.88 | 7.75 | 4.65% | 25:75 | 57 | 63 |
| 6 | 15.50 | 0 | 4.65% | 100:0 | 66 | |

All compositions contain: 30% by weight NaOCl (12.0%), 5% by weight KOH (45%), 8% by weight NaOH (50%), 1% Goodrite K7058, Q.S. water to 100%. Burco LDAO was used as the amine oxide.

Figure 1:
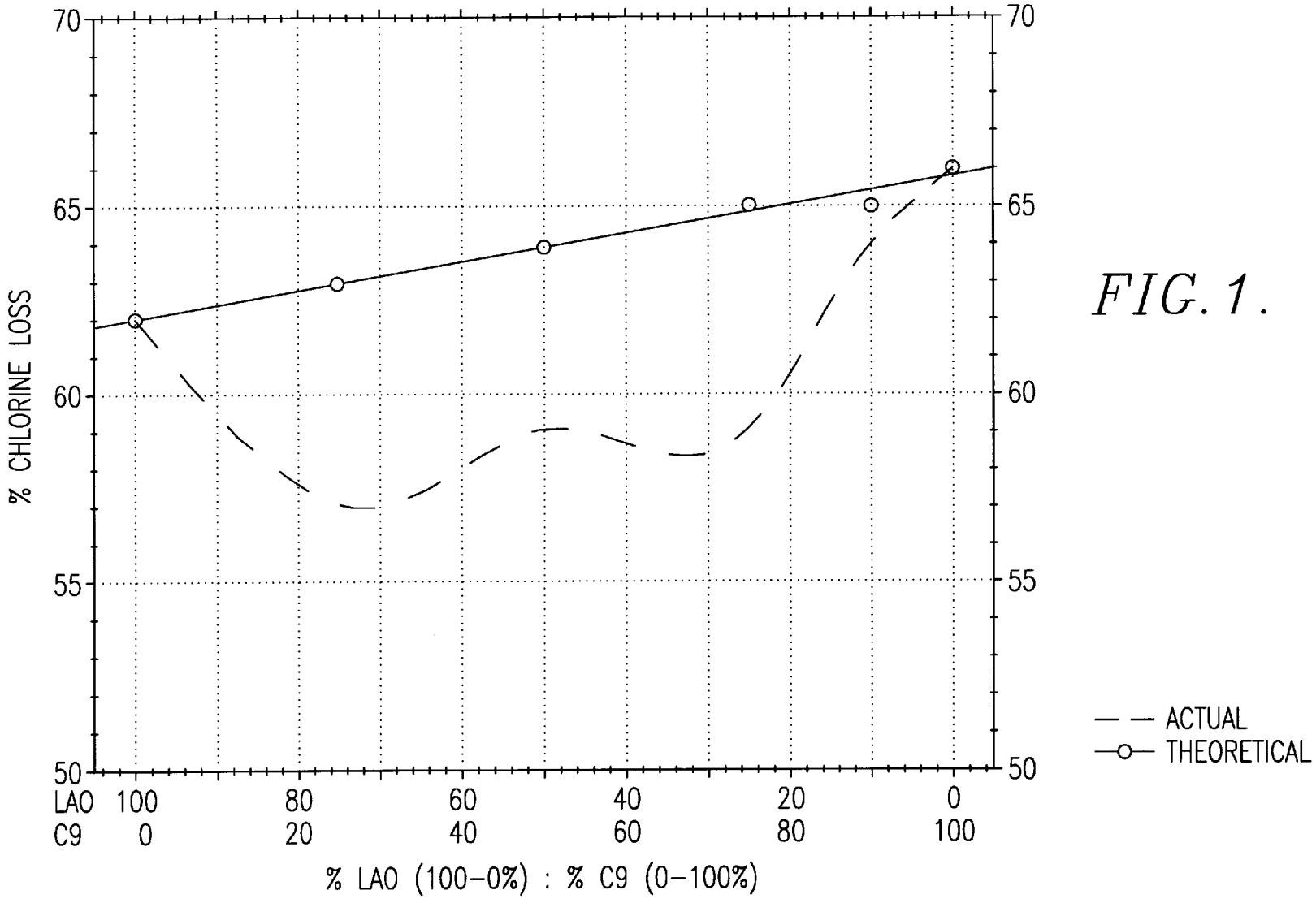
FIG. 1 is a plot of percent chlorine loss versus amount of $C_9$ fatty acid soap for various concentrate compositions in accordance with the invention.

FIG. 1 is a plot of actual and theoretical chlorine losses based upon the data developed in connection with compositions 1–6. This plot demonstrates that varying the weight ratio of amine oxide to soap between 90:10 and 25:75, respectively, results in compositions having substantially enhanced chlorine stability, as demonstrated by the reduction in chlorine loss of the actual versus the theoretical calculated losses.

In another series of tests $C_8$ and $C_{10}$ fatty acid soaps were employed, in order to study the effect of changing the carbon number of the soap upon chlorine stability. In the following table, composition 7 is the amine oxide reference sample, composition 8 is the $C_8$ soap reference sample and composition 9 is the $C_{10}$ soap reference sample. Compositions 10–13 demonstrate the effect of varying the weight ratio of amine oxide to soap between 25:75 and 90:10, when employing the $C_8$ soap as a part of the surfactant system. Compositions 14–17 demonstrate the effect of varying the weight ratio of amine oxide to soap between 25:75 and 90:10 when using the $C_{10}$ soap as a part of the surfactant system.

TABLE 2

| Composition | Wt. % Lauramine Oxide (30% by wt. solution) | Wt. % Potassium Octanoate (22.5% by wt. solution) | Wt. % Potassium Deconate (22.5% by wt. solution) | Total Active Surfactant | Wt. Ratio Amine Oxide:Soap | % Chlorine Loss 8 Weeks | % Chlorine Loss Theoretical |
|---|---|---|---|---|---|---|---|
| 7 | 15.5 | | | 4.65% | 100:0 | 69 | |
| 8 | | 20.6 | | 4.64% | 0:100 | 57 | |
| 9 | | | 20.6 | 4.64% | 0:100 | 53 | |
| 10 | 11.63 | 5.16 | | 4.65% | 75:25 | 51 | 66 |
| 11 | 7.75 | 10.40 | | 4.67% | 50:50 | 47 | 63 |
| 12 | 3.88 | 15.5 | | 4.65% | 25:75 | 48 | 60 |
| 13 | 13.95 | 2.10 | | 4.66% | 90:10 | 70 | 68 |
| 14 | 11.63 | | 5.16 | 4.65% | 75:25 | 50 | 65 |
| 15 | 7.75 | | 10.40 | 4.67% | 50:50 | 49 | 61 |
| 16 | 3.88 | | 15.5 | 4.65% | 25:75 | 49 | 57 |
| 17 | 13.95 | | 2.10 | 4.66% | 90:10 | 61 | 68 |

All compositions contain: 30% by weight NaOCL (13.0%), 2.5% by weight KOH (45%), 4.0% by weight NaOH (50%), 1% by weight Goodrite K7058, Q.S. water. Burco LDAO was the source of the amine oxide.

Figure 2:
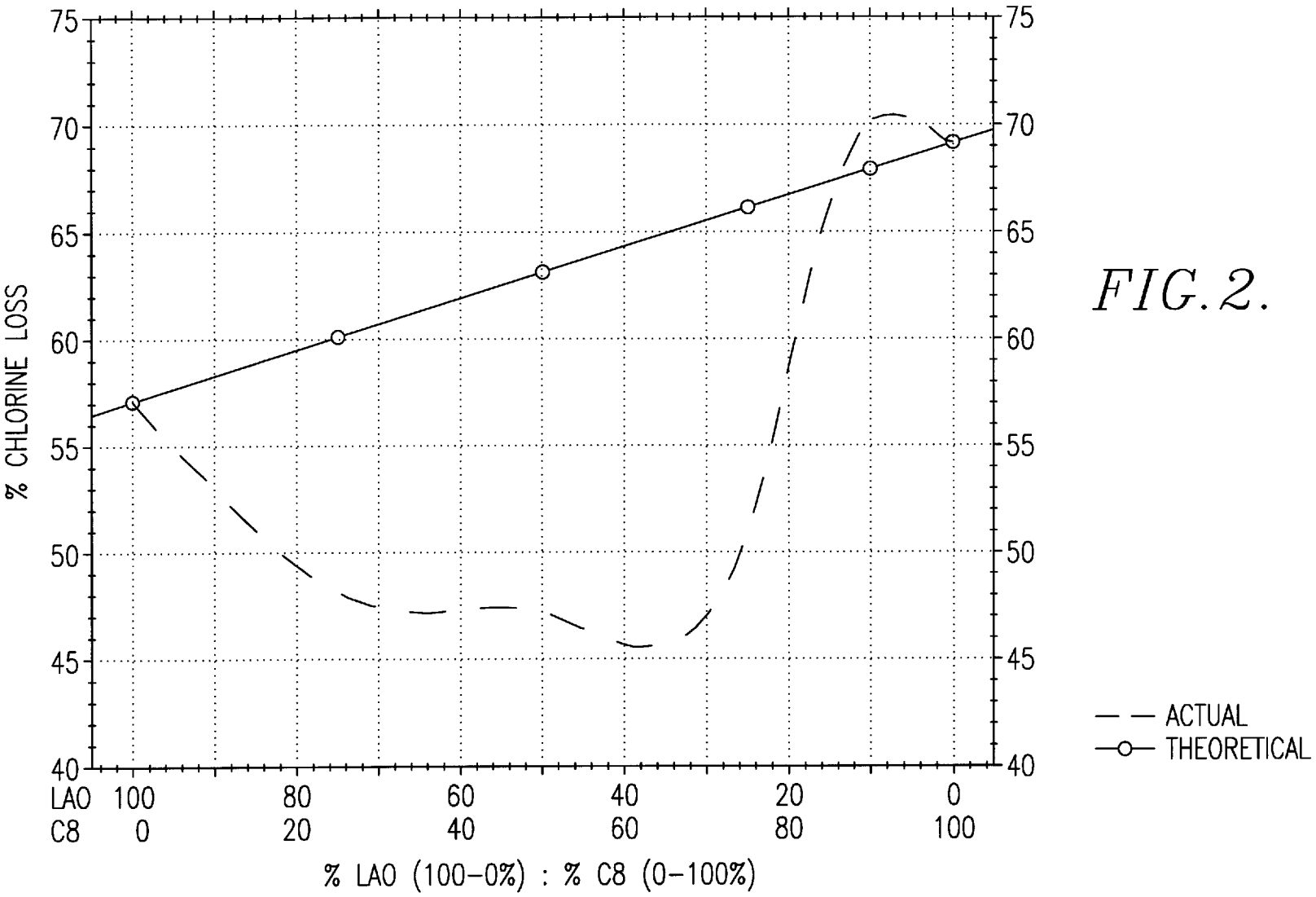
FIG. 2 is a plot similar to that of FIG. 1, but showing the chlorine loss versus amount of $C_8$ fatty acid soap for concentrate compositions of the invention.
Figure 3:
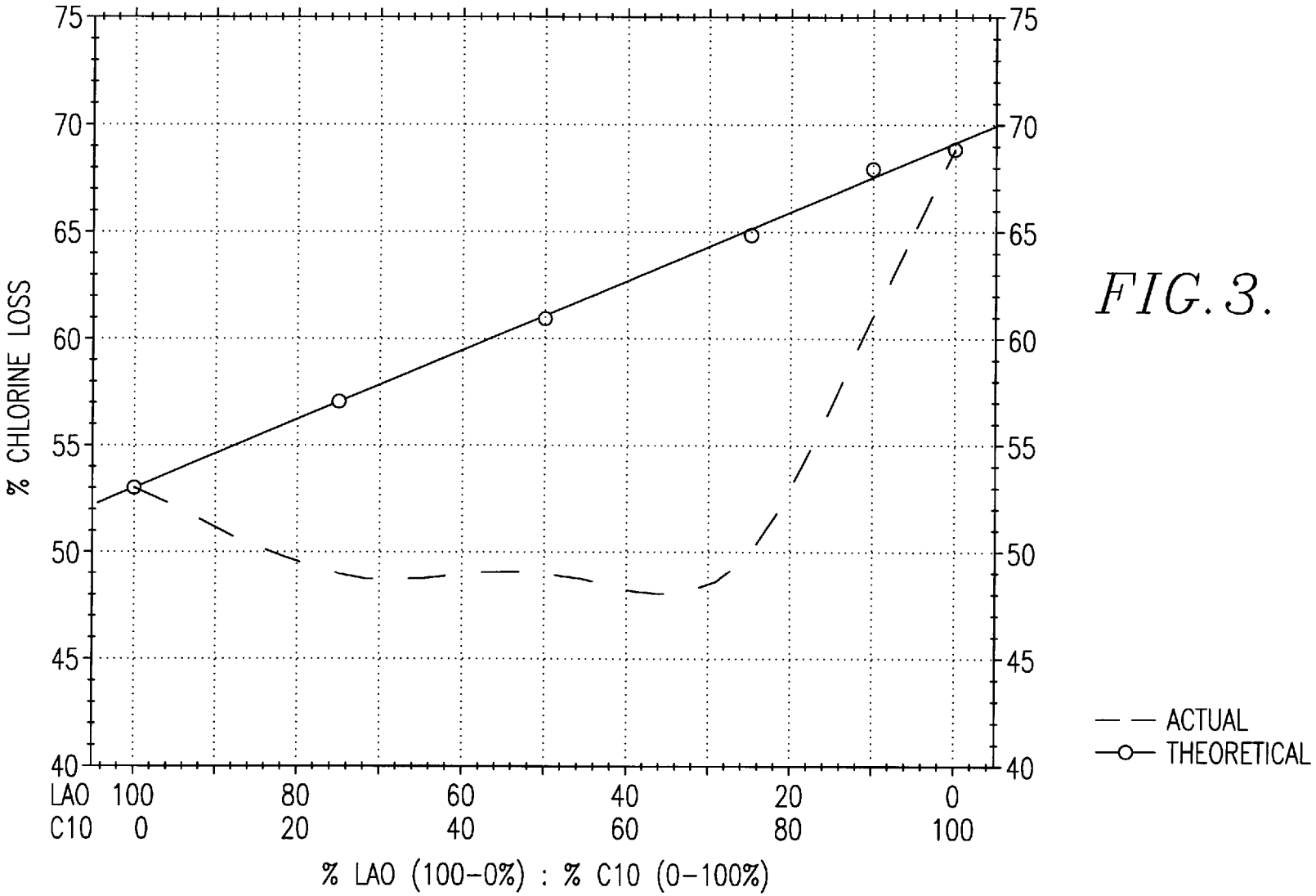
FIG. 3 is a plot of percent chlorine loss versus amount of $C_{10}$ fatty acid soap for various concentrate compositions of the invention.

FIG. 2 below is a plot of percent actual chlorine loss versus calculated theoretical chlorine loss for the $C_8$ soap compositions (compositions 10–13), whereas FIG. 3 is a similar plot for the $C_{10}$ soap compositions (compositions 14–17).

The data of Table 2 demonstrates that when $C_8$ and $C_{10}$ soaps are used, substantial reductions in chlorine loss can be obtained as compared with the theoretical losses.

The following compositions were prepared to demonstrate that $C_6$ and $C_{12}$ fatty acid soaps can also be used to good effect in the invention. In Table 3 below, composition 18 is the $C_6$ soap reference sample, composition 20 is the $C_{12}$ soap reference sample, and composition 22 is the amine oxide reference sample for both the $C_6$ and $C_{12}$ soap samples.

Another test was undertaken to demonstrate the effect of using various amine oxides having different alkyl substituent groups. This data is set forth in Table 4 below, which gives the specifics of compositions 23–39, and shows the effect of substituting the various amine oxides from different suppliers having different carbon number alkyl substituents. As set forth, substantially all commercially available amine oxides can be used in the surfactant systems of the invention.

TABLE 3

| Composition | Wt. % Lauramine Oxide (30% by wt. solution) | Wt. % Potassium Hexanoate (22.5% by wt. solution) | Wt. % Potassium Dodeconate (22.5% by wt. solution) | Total Active Surfactant | Wt. Ratio Amine Oxide:Soap | % Chlorine Loss 8 Weeks | % Chlorine Loss Theoretical |
|---|---|---|---|---|---|---|---|
| 18 | | 20.6 | | 4.64% | 0:100 | 83 | |
| 19 | 11.65 | 5.16 | | 4.66% | 75:25 | 76 | 92 |
| 20[1] | | | 20.16 | 4.64% | 0:100 | 59 | |
| 21 | 11.65 | | 5.16 | 4.66% | 75:25 | 52 | 86 |
| 22 | 15.5 | | | 4.65% | 100:0 | 95 | |

All compositions contain: 30% by weight NaOCL (12.3%), 2.5% buy weight KOH (45%), 4.0% by weight NaOH (50%), 1% by weight Goodrite K7058, Q.S. water.
Ninox L was used as the source of the amine oxide.
[1]Composition 20 solidified during the test.

TABLE 4

| Composition | Lauramine Oxide Source | Wt. % | Wt. % Potassium Nonanoate (45% by wt. solution) | Total Active Surfactant | Wt. Ratio Amine Oxide:Soap | % Chlorine Loss 8 Weeks | % Chlorine Less Theoretical |
|---|---|---|---|---|---|---|---|
| 23 | Burco LDAO | 11.65 | 3.85 | 5.23 | 67:33 | 53 | 70 |
| 24 | Bureo LDAO | 15.50 | 0 | 4.65 | 100:0 | 72 | |
| 25 | Incromine Oxide L | 11.65 | 3.85 | 5.23 | 67:33 | 50 | 61 |
| 26 | Incromine Oxide L | 15.50 | 0 | 4.65 | 100:0 | 62 | |
| 27 | Mackamine LO | 11.65 | 3.85 | 5.23 | 67:33 | 50 | 64 |
| 28 | Mackamine LO | 15.50 | 0 | 4.65 | 100:0 | 65 | |
| 29 | Stepan Ninox L | 11.65 | 3.85 | 5.23 | 67:33 | 58 | 81 |
| 30 | Stepan Ninox L | 15.50 | 0 | 4.65 | 100:0 | 88 | |
| 31 | | | 10.30 | 4.64 | 0:100 | 40 | |
| 32 | Ammonyx MO | 10.30 | 3.44 | 4.64 | 66:34 | 45 | 63 |
| 33[1] | Ammonyx MO | 15.50 | | 4.65 | 100:0 | 74 | |

TABLE 4-continued

| Composition | Lauramine Oxide Source | Wt. % | Wt. % Potassium Nonanoate (45% by wt. solution) | Total Active Surfactant | Wt. Ratio Amine Oxide:Soap | % Chlorine Loss 8 Weeks | % Chlorine Less Theoretical |
|---|---|---|---|---|---|---|---|
| 34 | Ammonyx MCO | 10.30 | 3.44 | 4.64 | 66:34 | 42 | 60 |
| 35[1] | Ammonyx MCO | 15.50 | | 4.65 | 100:0 | 69 | |
| 36 | Ammonyx LO | 10.30 | 3.44 | 4.64 | 66:34 | 40 | 50 |
| 37 | Ammonyx LO | 15.50 | | 4.65 | 100:0 | 55 | |
| 38[2] | Ammonyx SO | 12.40 | 3.44 | 4.65 | 66:34 | 100 | |
| 39[2] | Ammonyx SO | 18.60 | | 4.65 | 100:0 | 100 | |

Burco LDAO (30% by weight lauramine oxide) supplied by Burlington Chemical Co., Inc., Burlington, NC
Mackamine LO (30% by weight lauramine oxide) supplied by McIntyre Chemical Co., Ltd., Chicago, IL
Incromine oxide L (30% by weight lauramine oxide) supplied by Croda Surfactants, Inc., New York, NY
Ninol L (30% by weight lauramine oxide) supplied by Stepan Co., Northfield, IL
Ammonyx MO (30% by weight myristyl amine oxide), Ammonyx LO (30% by weight lauramine oxide), and Ammonyx SO (25% by weight stearamine oxide) are all supplied by Stepan Co.
All compositions contain: 30% by weight NaOCL (13.0% for compositions 23–30, 12.3% for compositions 31–39), 2.5% by weight KOH (45%), 4.0% by weight NaOH (50%), 1% by weight Goodrite K7058, Q.S. water to 100%.
[1]Compositions 33 and 35 gelled during the test.
[2]Compositions 38 and 39, the stearamine oxide did not completely dissolve.

In another series of tests, various amounts of KOH and NaOH were employed. The data is set forth in Table 5 and demonstrates that the compositions have reduced chlorine loss with levels of total base ranging from 1.125–4% by weight.

The next series of compositions demonstrate that reduced chlorine loss can be obtained with NaOCl levels of from about 0.6–6% by weight, with 1.125 by weight KOH and 2.0% by weight NaOH levels. This data is set forth in Table 7.

TABLE 5

| Composition | Wt. % KOH (45% by wt. solution) | Wt. % NaOH (50% by wt. solution) | Wt. % Lauramine Oxide (30% by wt. solution) | Wt. % Potassium Nonanoate (45% by wt. solution) | Total Active Surfactant | Wt. Ratio Amine Oxide:Soap | % Chlorine Loss 4 weeks | % Chlorine Loss 8 Weeks | % Theoretical 4 Weeks |
|---|---|---|---|---|---|---|---|---|---|
| 40 | 0 | 8 | 11.65 | 3.85 | 5.23 | 67:33 | | 61.4 | |
| 41 | 0 | 8 | 15.50 | 0 | 4.65 | 100:0 | | 66.7 | |
| 42 | 5 | 0 | 11.65 | 3.85 | 5.23 | 67:33 | | 60.6 | |
| 43 | 5 | 0 | 15.50 | 0 | 4.65 | 100:0 | | 96.7 | |
| 44 | 2.5 | 4 | 11.65 | 3.85 | 5.23 | 67:33 | | 54.2 | |
| 45 | 2.5 | 4 | 15.50 | 0 | 4.65 | 100:0 | | 78.3 | |
| 46 | 2.5 | | 10.30 | 3.44 | | 67:33 | 45.8 | 80.8 | 72.4 |
| 47 | 2.5 | | 15.5 | 0 | | 100:0 | 99.1 | 100 | |
| 48 | 2.5 | | | 10.33 | | 0:100 | 19.8 | 33.6 | |
| 49 | 1.0 | | 10.3 | 3.44 | | 67:33 | 99.8 | 100 | |
| 50 | 1.0 | | 15.5 | 0 | | 100:0 | 99.7 | 100 | |
| 51 | 1.0 | | | 10.33 | | 0:100 | 27.9 | 91.9 | |

All Compositions Nos. 40–45 contain: 30% by weight NaOCl (12.0%), 1% by weight Goodrite K7058, Q.S. water to 100%. Burco LDAO was used as the source of the amine oxide. All Compositions Nos. 46–51 contain: 30% by weight NaOCl (12.3%), 1% by weight Goodrite K7058, Q.S. water to 100%. Ninox L was the source of the amine oxide.

In the next test, the effect of varying the level of initial chlorine was studied. This data is given in Table 6 wherein compositions 53, 55 and 57 are reference compositions. Compositions 52–57 demonstrate that reduced chlorine loss can be obtained when the level of NaOCl is varied between 1.2–4.8% by weight.

TABLE 6

| Composition | Wt. % NaOCl (12.0% by wt. solution) | Wt. % Lauramine Oxide (30% by wt. solution) | Wt. % Potassium Nonanoate (45% by wt. solution) | Total % Active Surfactant | Wt. Ratio Amine Oxide:Soap | Chlorine Loss 8 Weeks |
|---|---|---|---|---|---|---|
| 52 | 20 | 11.65 | 3.85 | 5.23 | 67:33 | 55 |
| 53 | 20 | 15.5 | 0 | 4.65 | 100:0 | 64 |
| 54 | 10 | 11.65 | 3.85 | 5.23 | 67:33 | 68 |
| 55 | 10 | 15.5 | 0 | 4.65 | 100:0 | 92 |
| 56 | 40 | 11.65 | 3.85 | 5.23 | 67:33 | 72 |
| 57 | 40 | 15.5 | 0 | 4.65 | 100:0 | 74 |

All compositions contain: 5% by weight KOH (45%), 8% by weight NaOH (50%), 1% by weight Goodrite K7058, Q.S. water to 100%. Burco LDAO was used as the source of the amine oxide.

TABLE 7

| Composition | Wt. % NaOCl (12.3% by wt. solution) | Wt. % Lauramine Oxide (30% by wt. solution) | Wt. % Potassium Nonanoate (45% by wt. solution) | Total % Active Surfactant | Wt. Ratio Amine Oxide Soap | % Chlorine Loss 4 Weeks | % Chlorine Loss 8 Weeks | Theoretical |
|---|---|---|---|---|---|---|---|---|
| 58 | 5 | 15.5 | | 4.65 | 100:0 | 95.8 | 100 | |
| 59 | 5 | 10.33 | 3.44 | 4.65 | 67:33 | 57.7 | 97 | 66[1] |
| 60 | 5 | | 10.3 | 4.64 | 0:100 | 7.3 | 20 | |
| 61 | 50 | 15.5 | | 4.65 | 100:0 | | 98 | |
| 62 | 50 | 10.33 | 3.44 | 4.65 | 67:33 | | 60 | 85[2] |
| 63 | 50 | | 10.3 | 4.64 | 0:100 | | 60 | |

[1]Based on 4 weeks result
[2]Based on 8 weeks result
All compositions contain: 2.5% by weight KOH (45%), 4.0% by weight NaOH (50%), 1% by weight Goodrite K7058, Q.S. water to 100%.
Ammonyx LO was the source of the amine oxide.

A further set of test compositions was prepared wherein the surfactant system concentration range was varied between 3% and 6% by weight. This data is given in Table 8.

TABLE 8

| Composition | Wt. % Lauramine Oxide (30% by wt. solution) | Wt. % Potassium Nonanoate (45% by wt. solution) | Total % Active Surfactant | Wt. Ratio Amine Oxide:Soap | % Chlorine Loss 8 Weeks | Chlorine Loss Theoretical |
|---|---|---|---|---|---|---|
| 64 | 10 | | 3.0 | 100:0 | 44 | |
| 65 | 7.5 | 1.66 | 3.0 | 75:25 | 41 | 40 |
| 66 | | 68 | 3.0 | 0:100 | 28 | |
| 67 | 20.0 | | 6.0 | 100:0 | 73 | |
| 68 | 15.0 | 3.35 | 6.0 | 75:25 | 45 | 65 |
| 69 | | 13.35 | 6.0 | 0:100 | 42 | |

All compositions contain: 2.5% by weight KOH (45%), 30% by weight NaOCl (12.0%), 4% by weight NaOH (50%), 1% by weight Goodrite K7058, Q.S. water to 100%.
Burco LDAO was used as the source of the amine oxide.

It has also been found that various levels of optional ingredients such as chlorine stable polyacrylate (employed for thresholding, chelating and rinsing properties), sodium tripolyphosphate, silicates, bases and other chlorine stable surfactants (e.g., Dowfax 3B2) can also be employed without detracting from the desirable properties of the compositions of the invention.

The various commercial products identified in the foregoing Examples are further described in individual product bulletins distributed by the manufacturers thereof. These product bulletins are hereby incorporated by reference herein.

We claim:

1. A stable, aqueous chlorine concentrate composition consisting essentially of the following ingredients dispersed in water:

from about 0.5–8% by weight of alkaline metal hypochlorite;

from about 3–12% by weight of alkali metal hydroxide; and from about 3.5–6% by weight of a binary surfactant system consisting essentially of respective amounts of chlorine-stable trialkylamine oxide and saturated $C_5$–$C_{12}$ fatty acid soap with an amine oxide:fatty acid soap weight ratio of from about 90:10 to 25:75, said composition having a pH above 12.5.

2. The composition of claim 1, said hypochlorite being present at a level of from about 1.5–5% by weight.

3. The composition of claim 1, said amine oxide:fatty acid soap rate ratio being from about 25:75 to 75:25.

4. The composition of claim 1, wherein said amine oxide is selected from the group consisting of compounds of the formula

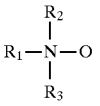

where $R_1$ is a saturated $C_8$–$C_{16}$ alkyl group, and $R_2$ and $R_3$ are each individually taken from the group consisting of $C_1$–$C_4$ alkyl groups.

5. The composition of claim 4, said $C_8$–$C_{16}$ alkyl group being linear.

6. The composition of claim 4, $R_2$ and $R_3$ each being a methyl group.

7. The composition of claim 1, said pH being above about 13.

8. The composition of claim 1, said amine oxide being present at a level of from about 0.75–6% by weight.

9. The composition of claim 1, said fatty acid soap being present at a level of from about 0.75–6% by weight.

* * * * *